US006557968B2

(12) United States Patent
Lee et al.

(10) Patent No.: US 6,557,968 B2
(45) Date of Patent: May 6, 2003

(54) FLUID JETTING APPARATUS AND A PROCESS FOR MANUFACTURING THE SAME

(75) Inventors: Byoung-chan Lee, Seoul (KR); Soon-cheol Kweon, Seoul (KR); Kyoung-jin Park, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/043,512

(22) Filed: Jan. 11, 2002

(65) Prior Publication Data

US 2002/0089571 A1 Jul. 11, 2002

Related U.S. Application Data

(62) Division of application No. 09/455,022, filed on Dec. 6, 1999, now Pat. No. 6,367,705.

(30) Foreign Application Priority Data

Dec. 10, 1998 (KR) ..... 98-54151

(51) Int. Cl.[7] ..... B41J 2/015

(52) U.S. Cl. ..... 347/21; 347/47; 347/63

(58) Field of Search ..... 347/20, 21, 49, 347/65, 56, 62, 47; 239/1; 216/27

(56) References Cited

U.S. PATENT DOCUMENTS

| | | | | |
|---|---|---|---|---|
| 5,322,594 A | | 6/1994 | Bol | 216/27 |
| 5,478,606 A | | 12/1995 | Ohkuma et al. | 427/555 |
| 6,142,616 A | | 11/2000 | Akahane | 347/71 |
| 6,145,965 A | | 11/2000 | Inada et al. | 347/65 |
| 6,390,606 B1 | * | 5/2002 | Terui et al. | 347/63 |

FOREIGN PATENT DOCUMENTS

| | | |
|---|---|---|
| JP | 2-249652 | 10/1990 |
| JP | 8-118632 | 5/1996 |

* cited by examiner

*Primary Examiner*—Lamson Nguyen
(74) *Attorney, Agent, or Firm*—Staas & Halsey LLP

(57) ABSTRACT

A fluid jetting apparatus for a print head employed in an output apparatus, and a manufacturing process thereof. The process for manufacturing a fluid jetting apparatus includes: (1) forming a heat driving part having a sacrificial layer; (2) forming a membrane on the heat driving part which includes the sacrificial layer; (3) forming a nozzle part on the membrane; and (4) removing the sacrificial layer. The step (1) further includes: (i) forming an electrode and an exothermic body on a substrate; (ii) laminating a working fluid barrier on the electrode and the exothermic body, and forming a working fluid chamber in the working fluid barrier; (iii) forming a protective layer on the working fluid barrier, the electrode, and the exothermic body; (iv) forming a sacrificial layer within the working fluid chamber at a same height as the working fluid barrier. The fluid jetting apparatus includes a heat driving part for generating a driving force, a nozzle part having a jetting fluid chamber interconnected to an exterior through a nozzle, and a membrane for transmitting the driving force generated from the heat driving part to the nozzle part. Here, the heat driving part includes an electrode and a heating element formed on a substrate; a plane layer formed on the substrate at the same height as the electrode and the heating element combined; a protective layer laminated on the plane layer; and a working fluid chamber laminated on the protective layer, the working fluid chamber for holding a working fluid which is to be expanded by the exothermic body to generate the driving force. Accordingly, since the heat driving part, the membrane, and the nozzle part are sequentially laminated to be integrally formed with each other, an adhering process is no longer required. As a result, due to a very simplified manufacturing processes, productivity, reliability, and quality of the fluid jetting apparatus are enhanced, while a percentage of defective parts is decreased.

4 Claims, 15 Drawing Sheets

FLUID JETTING APPARATUS AND A PROCESS FOR MANUFACTURING THE SAME

This application is a divisional of application Ser. No. 09/455,022, filed Dec. 6, 1999, now U.S. Pat. No. 6,367,705.

CROSS-REFERENCE TO RELATED APPLICATIONS

This application claims the benefit of Korean Application No. 98-54151, filed Dec. 10, 1998, in the Korean Patent Office, the disclosure of which is incorporated herein by reference.

BACKGROUND OF THE INVENTION

1. Field of the Invention

The present invention relates to a fluid jetting apparatus and a process for manufacturing the same, and more particularly, to a fluid jetting apparatus for a print head which is employed in output apparatuses such as an ink-jet printer, a facsimile machine, etc. to jet fluid through a nozzle, and a manufacturing process thereof.

2. Description of the Related Art

A print head is a part or a set of parts which are capable of converting output data into a visible form on a predetermined medium using a type of printer. Generally, such a print head for an ink jet printer, and the like, uses a fluid jetting apparatus which is capable of jetting the predetermined amount of fluid through a nozzle to an exterior of a fluid chamber holding the fluid by applying a physical force to the fluid chamber.

According to methods for applying physical force to the fluid within the fluid chamber, the fluid jetting apparatus is roughly grouped into a piezoelectric system and a thermal system. The piezoelectric system pushes out the ink within the fluid chamber through a nozzle through an operation of a piezoelectric element which is mechanically expanded in accordance with a driving signal. The thermal system pushes the fluid through the nozzle by means of bubbles which are produced from the fluid within the fluid chamber by the heat generated by an exothermic body. Recently, also, a thermal compression system has been developed, which is an improved form of the thermal system. The thermal compression system is for jetting out the fluid by driving a membrane by instantly heating a vaporizing fluid which acts as a working fluid.

FIG. 1 is a vertical sectional view of a fluid jetting apparatus according to a conventional thermal compression system. The fluid jetting apparatus of the thermal compression system includes a heat driving part 10, a membrane 20, and a nozzle part 30.

A substrate 11 of the heat driving part 10 supports the heat driving part 10 and the whole structure that will be constructed later. An insulated layer 12 is diffused on the substrate 11. An electrode 14 is made of a conductive material for supplying an electric power to the heat driving part 10. An exothermic body 13 is made of a resistive material having a predetermined resistance for expanding a working fluid by converting electrical energy into heat energy. Working fluid chambers 16 and 17 contain the working fluid, to maintain a pressure of the working fluid which is heat expanded, are connected by a working fluid introducing passage 18, and are formed within a working fluid barrier 15.

Further, the membrane 20 is a thin layer which is adhered to an upper portion of the working fluid barrier layer 15 and working; fluid chambers 16 and 17 to be moved upward and downward by the pressure of the expanded working fluid. The membrane 20 includes a polyimide coated layer 21 and a polyimide adhered layer 22.

Jetting fluid chambers 37 and 38 are chambers which are formed to enclose the jetting fluid. When the pressure is transmitted to the jetting fluid through the membrane 20, the jetting fluid is jetted only through a nozzle 35 formed in a nozzle plate 34. Here, the jetting fluid is the fluid which is pushed out of the jetting fluid chambers 37 and 38 in response to the driving of the membrane 20, and is finally jetted to the exterior. A jetting fluid introducing passage 39 connects the jetting fluid chambers 37 and 38. The jetting fluid chambers 37 and 38 and the jetting fluid introducing passage 39 are formed in a jetting fluid barrier layer 36. The nozzle 35 is an orifice through which the jetting fluid held using the membrane 20 and the jetting fluid chambers 37 and 38 is emitted to the exterior. Another substrate 31 (see FIGS. 4A and 4B) of the nozzle part 30 is temporarily employed for constructing the nozzle part 30, and should be removed before the nozzle part 30 is assembled.

FIG. 2 shows a process for manufacturing the fluid jetting apparatus according to a conventional roll method.

As shown in FIG. 2, the nozzle plate 34 is transferred from a feeding reel 51 to a take-up reel 52. In the process of transferring the nozzle plate 34 from the feeding reel 51 to the take-up reel 52, a nozzle is formed in the nozzle plate 34 by laser processing equipment 53. After the nozzle is formed, air is jetted from an air blower 54 so as to eliminate extraneous substances attached to the nozzle plate 34. Next, an actuator chip 40, which is laminated on a substrate to the jetting fluid barrier, is bonded with the nozzle plate 34 by a tab bonder 55, and accordingly, the fluid jetting apparatus is completed. The completed fluid jetting apparatuses are wound around the take-up reel 52 to be preserved, and then sectioned in pieces in the manufacturing process for the print head. Accordingly, each piece of the fluid jetting apparatuses is supplied into the manufacturing line of a printer.

The process for manufacturing the, fluid jetting apparatus according to the conventional thermal compression system will be described below with reference to the construction of the fluid jetting apparatus shown in FIG. 1.

FIGS. 3A and 3B are views for showing a process for manufacturing the heat driving part and FIG. 3C is a view for showing a process for manufacturing the membrane on the heat driving part of the conventional fluid jetting apparatus. FIGS. 4A to 4C are views for showing the process for manufacturing the nozzle part.

In order to manufacture the conventional fluid jetting apparatus, the heat driving part 10 and the nozzle part 30 should be manufactured separately. Here, the heat driving part 10 is completed as the separately-made membrane 20 is adhered to the working fluid barrier layer 15 of the heat driving part 10. After that, by reversing and adhering the separately-made nozzle part 30 to the membrane 20, the fluid jetting apparatus is completed.

FIG. 3A shows a process for diffusing the insulated layer 12 on the substrate 11 of the heat driving part 10, and for forming an exothermic body 13 and an electrode 14 on the insulated layer 12 in turn. Referring to FIG. 3B, working fluid chambers 16 and 17 and a working fluid passage 18 are formed by performing an etching process of the working fluid barrier layer 15 through a predetermined mask patterning. More specifically, the heat driving part 10 is formed as the insulated layer 12, the exothermic body 13, the electrode 14, and the working fluid barrier layer 15 are sequentially laminated on the substrate 11 (which is a silicon substrate). In such a situation, the working fluid chambers 16 and 17 (which are filled with the working fluid to be expanded by heat, are formed on an etched portion of the working fluid barrier layer 15. The working fluid is introduced through the working fluid introducing passage 18.

FIG. 3C shows a process for adhering the separately-made membrane 20 to the upper portion of the completed heat driving part 10. The membrane 20 is a thin diaphragm, which is to be driven toward the jetting fluid chamber 37 (see FIG. 1) by the working fluid which is heated by the exothermic body 13.

FIG. 4A shows a process for manufacturing a nozzle 35 using the laser processing equipment 53 (shown in FIG. 2) after an insulated layer 32 and the nozzle plate 34 are sequentially formed on a substrate 31 of the nozzle part 30. FIG. 4B shows a process for forming the jetting fluid barrier layer 36 on the upper portion of the construction shown in FIG. 4A, and jetting fluid chambers 37 and 38 and the fluid introducing passage by an etching process through a predetermined mask patterning. FIG. 4C shows a process for exclusively separating the nozzle part 10 from the substrate 31 of the nozzle part 30. The nozzle part 30 includes the jetting fluid barrier layer 36 and the nozzle plate 34. On the etched portion of the jetting fluid barrier layer 36, the jetting fluid chambers 37 and 38 filled with the fluid to be jetted are formed. The jetting fluid such as an ink, or the like, is introduced through the jetting fluid introducing passage 39 (see FIG. 1) for introduction of the jetting fluid. The nozzle 35 is formed on the nozzle plate 34 to be interconnected with the jetting fluid chamber 37, so that the fluid is jetted through the nozzle 35. The nozzle part 30 is manufactured by the processes that are shown in FIGS. 4A to 4C. First, the nozzle plate 34 inclusive of the nozzle 35, is formed on the substrate 31 having the insulated layer 32 through an electroplating process. Next, the jetting fluid barrier layer 36 is laminated thereon, and the jetting fluid chambers 37 and 38 and the jetting fluid introducing passage 39 are formed through a lithographic process. Finally, as the insulated layer 32 and the substrate 31 are removed, the nozzle part 30 is completed. The completed nozzle part 30 is reversed, and then adhered to the membrane 20 of a membrane, heat driving part assembly which has been assembled beforehand. More specifically, the jetting fluid barrier 36 of the nozzle part 30 is adhered to the polyimide coated layer 21 of the membrane 20.

The operation of the fluid jetting apparatus according to the thermal compression system will be described below with reference to the construction shown in FIG. 1.

First, an electric power is supplied through the electrode 14, and an electric current flows through the exothermic body 13 connected to the electrode 14. Since the exothermic body 13 generates heat due to its resistance, the fluid within the working fluid chamber 16 is subjected to a resistance heating, and the fluid starts to vaporize when the temperature thereof exceeds a predetermined temperature. As the amount of the vaporized fluid increases, the vapor pressure accordingly increases. As a result, the membrane 20 is driven upward. More specifically, as the working fluid undergoes a thermal expansion, the membrane 20 is pushed upward in a direction indicated by the arrow in FIG. 1. As the membrane 20 is pushed upward, the fluid within the jetting fluid chamber 37 is jetted out toward an exterior through the nozzle 35.

Then, when the supply of electric power is stopped, the resistance heating of the exothermic body 13 is no longer generated. Accordingly, the fluid within the working fluid chamber 16 is cooled to a liquid state, so that the volume thereof decreases and the membrane 20 recovers its original shape.

Meanwhile, a conventional material of the nozzle plate 34 is mainly made of nickel, but the trend in using the material of a polyimide synthetic resin has increased recently. When the nozzle plate 34 is made of the polyimide synthetic resin, it is fed in a reel type. The fluid jetting apparatus is completed by the way a chip laminated from the silicon substrate to the jetting fluid barrier layer 36 is bonded on the nozzle plate 34 fed in the reel type.

According to the conventional fluid jetting apparatus and its manufacturing process, however, since the heat driving part, the membrane, and the nozzle part have to be separately made before such are adhered to each other by three adhering processes, the productivity has been decreased. Further; since the adhesion between the heat driving part and the membrane, and between the membrane and, the nozzle part are often unreliable, the working fluid and the jetting fluid often leak, so that a fraction defective has been increased, and the reliability and quality of the fluid jetting apparatus has been deteriorated.

SUMMARY OF THE INVENTION

The present invention has been made to overcome the above-described problems of the prior art, and accordingly it is an object of the present invention to provide a fluid jetting apparatus and a manufacturing process thereof capable of improving the reliability, quality and the productivity of the fluid jetting apparatus by sequentially laminating a heat driving part, a membrane, and a nozzle part to form the fluid jetting apparatus, instead of adhering the same to each other.

Additional objects and advantages of the invention will be set forth in part in the description which follows and, in part, will be obvious from the description, or may be learned by practice of the invention.

The above and other objects are accomplished by a method of manufacturing a fluid jetting apparatus according to the present invention, including: (1) forming a heat driving part having a sacrificial layer; (2) forming a membrane on the heat driving part which includes the sacrificial layer; (3) forming a nozzle part on the membrane; and (4) removing the sacrificial layer.

The step (1) includes: (i) forming an electrode and an exothermic body on a substrate; (ii) laminating a working fluid barrier on the electrode and the exothermic body, and forming a working fluid chamber in the working fluid barrier; (iii) forming a protective layer on the working fluid barrier, the electrode, and the exothermic body; (iv) forming a sacrificial layer on the protective layer and within the working fluid chamber at the same height as the working fluid barrier.

Further, the step (1) may otherwise include: (i) forming an electrode and an exothermic body on a substrate; (ii) forming a plane layer on the substrate at the same height as the electrode and the exothermic body combined; (iii) laminating a protective layer on the electrode and the plane layer; (iv) laminating the working fluid barrier on the protective layer, and forming a working fluid chamber in the working fluid barrier; and (v) forming the sacrificial layer on the protective layer and within an interior of the working fluid chamber at the same height as the working fluid barrier.

The step (2) is performed through a spin coating process.

The step (3) includes: (i) laminating a jetting fluid barrier on the membrane, and forming a jetting fluid chamber in the jetting fluid barrier; and (ii) laminating a nozzle plate on the jetting fluid barrier, and forming a nozzle in the nozzle plate. The nozzle plate is laminated through a process for laminating a dry film.

The above and other objects of the present invention may further be achieved by providing a fluid jetting apparatus including a heat driving part which generates a driving force, a nozzle part having a jetting fluid chamber interconnected to an exterior of the fluid jetting apparatus through a nozzle, and a membrane which transmits the driving force generated from the heat driving part to the nozzle part, wherein the heat driving part comprises: an electrode and an exothermic body formed on a substrate; a plane layer formed on the substrate at the same height as the electrode and the exothermic body combined; a protective layer laminated on the plane layer; and a working fluid barrier laminated on the protective layer, and provided with the working fluid chamber for holding a working fluid which is expanded by the exothermic body to generate the driving force.

BRIEF DESCRIPTION OF THE DRAWINGS

The above objects and advantages will become more apparent and more readily appreciated by describing the preferred embodiments in greater detail with reference to the accompanying drawings, in which.

DETAILED DESCRIPTION OF THE PREFERRED EMBODIMENTS

Figure 1:
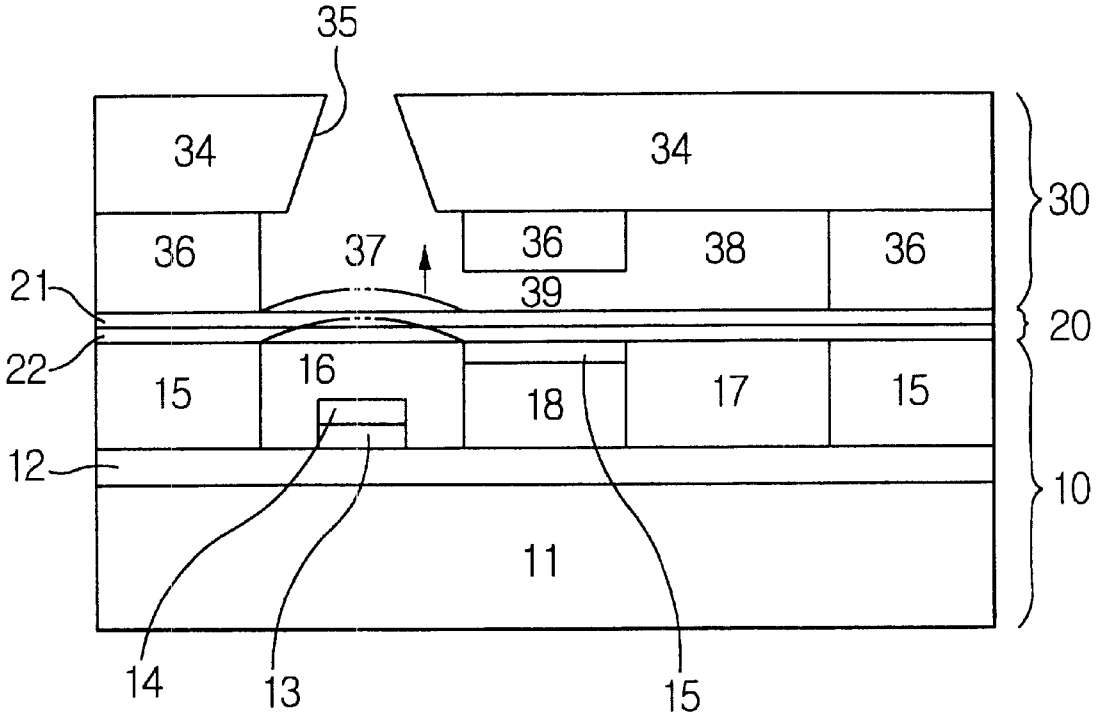
FIG. 1 (PRIOR ART)
FIG. 1 is a vertical sectional view of a fluid jetting apparatus according to a conventional thermal compression system.
Figure 2:
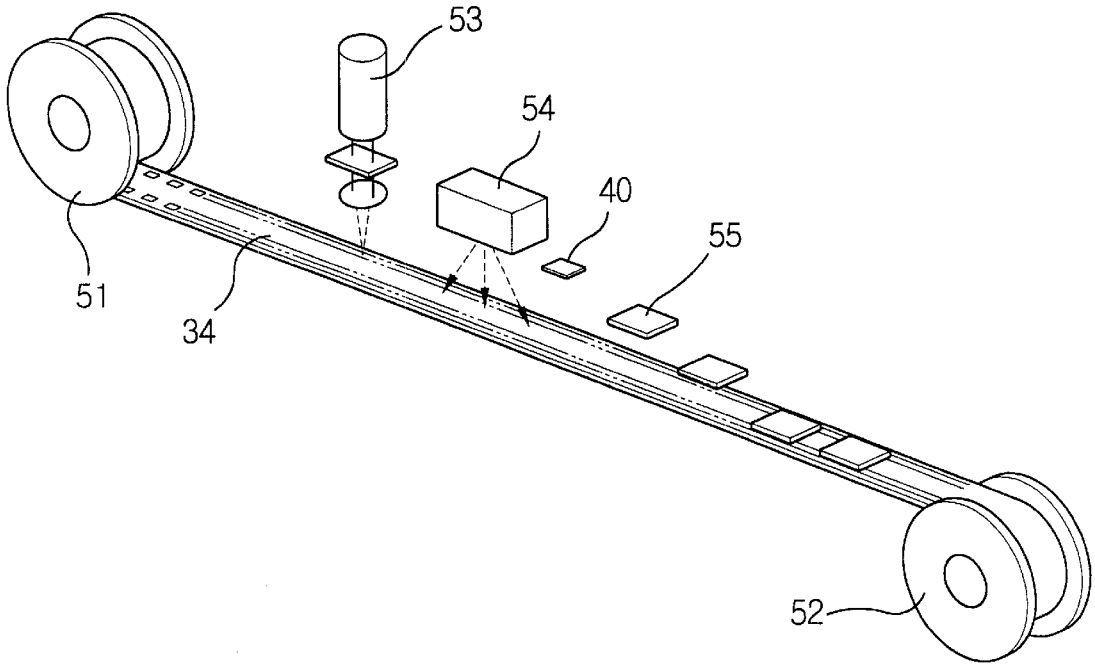
FIG.2 (PRIOR ART)
FIG. 2 is a view showing a process For manufacturing a fluid jetting apparatus according to a conventional roll method.
Figure 3A:
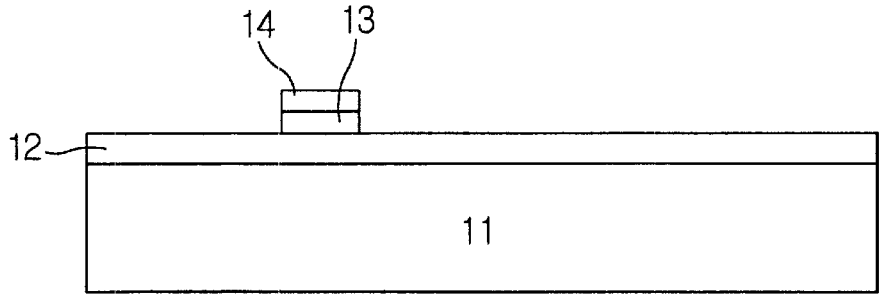
FIG.3A (PRIOR ART)
FIGS. 3A and 3B are views showing a process for manufacturing a heat driving part and FIG. 3C is a view showing a process for manufacturing a membrane on the heat driving part of the fluid jetting apparatus according to the conventional systems.
Figure 3B:
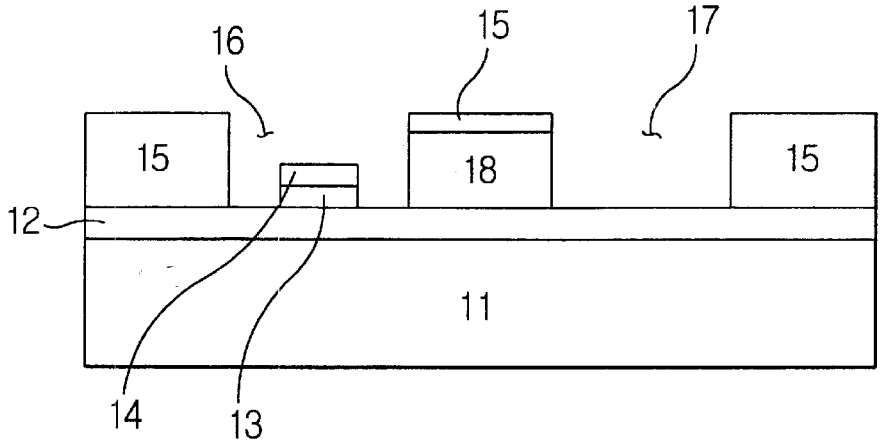
FIG.3B (PRIOR ART)
Figure 3C:
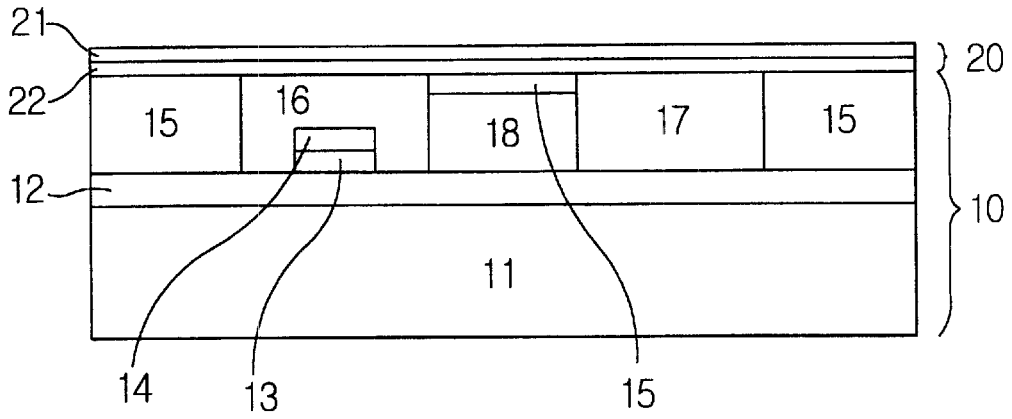
FIG.3C (PRIOR ART)
Figure 4A:
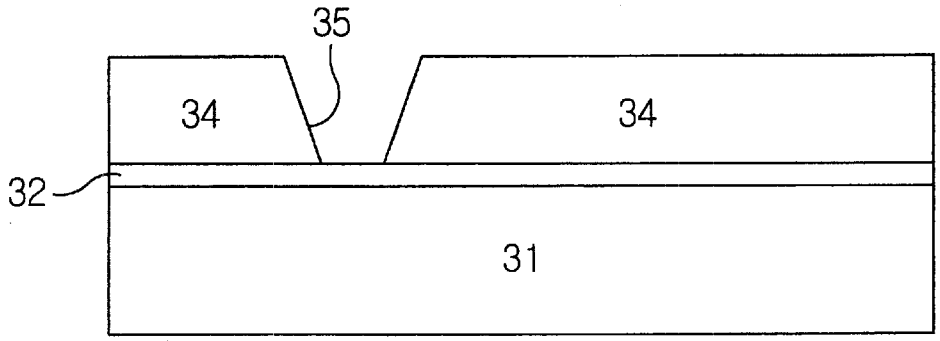
FIG.4A (PRIOR ART)
FIGS. 4A to 4C are views showing a process for manufacturing a nozzle part of the fluid jetting apparatus according to the conventional thermal compression system.
Figure 4B:
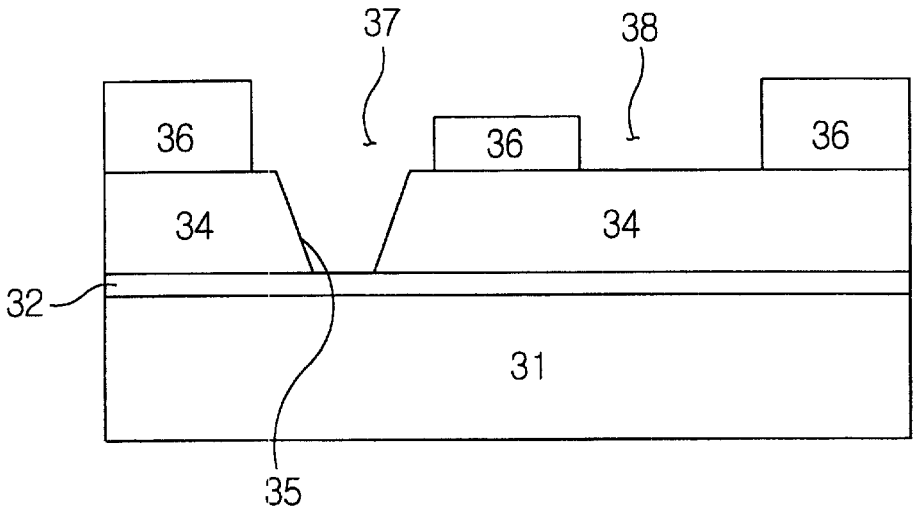
FIG.4B (PRIOR ART)
Figure 4C:
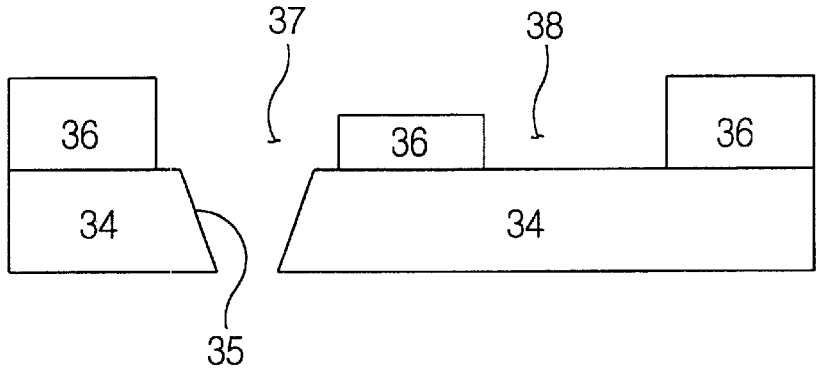
FIG.4C (PRIOR ART)

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 5:
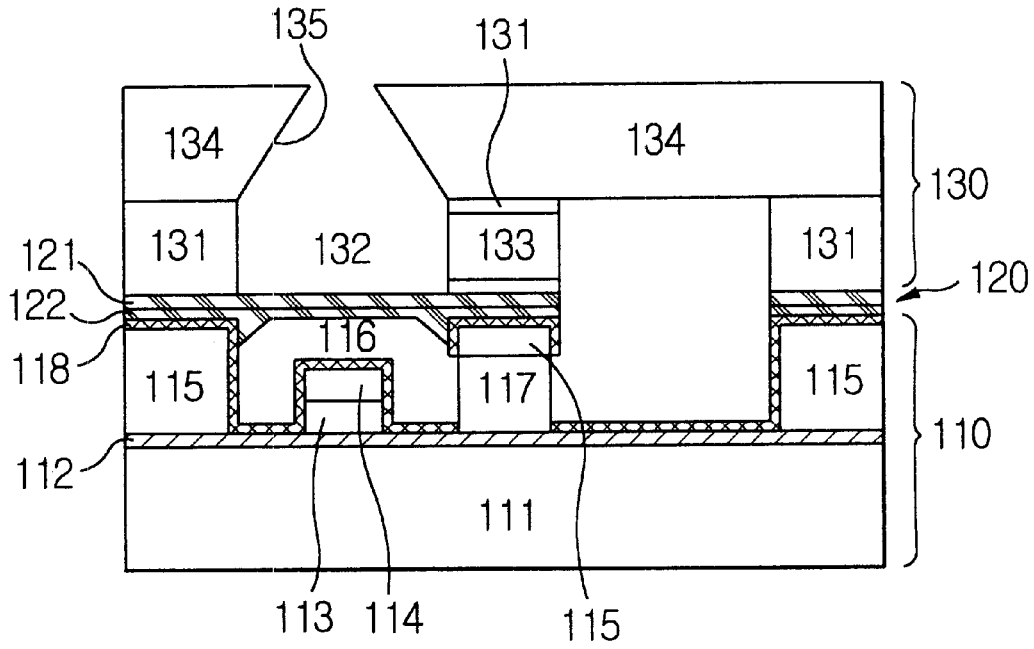
FIG. 5 is a vertical sectional view of the fluid jetting apparatus according to a first embodiment of the present invention.

FIG. 5 is a vertical sectional views of a fluid jetting apparatus according to a first embodiment of the present invention, and FIGS. 6A to 6H are views showing a process for manufacturing the fluid jetting apparatus according to the first embodiment of the present invention.

A reference numeral 110 refers to a heat driving part, 120 is a membrane, and 130 is a nozzle part.

With respect to the heat driving part 110, the reference numeral 111 is a substrate, 112 is an insulated layer, 113 is an exothermic body, and 114 is an electrode. The reference numeral 115 is a working fluid barrier, 116 is a working fluid chamber, and 117 is a working fluid passage. The reference numeral 118 is a protective layer, and 119 is a sacrificial layer.

With respect to the membrane 120, the reference numeral 121 is a polyimide coated layer, and 122 is a polyimide adhered layer.

With respect to the nozzle part 130, the reference numeral 131 is a jetting fluid barrier, 132 is a jetting fluid chamber, and 133 is a jetting fluid passage. The reference numeral 134 is a nozzle plate, and 135 is a nozzle.

A fluid jetting apparatus according to the first embodiment of the present invention has the same construction as the related art. Accordingly, a further description thereof will be omitted.

A manufacturing process according to the first embodiment of the present invention includes: forming the heat driving part 110 inclusive of the sacrificial layer 119; forming the membrane 120 on the heat driving part 10; forming the nozzle part 130 on the membrane 120, and removing the sacrificial layer 119.

Figure 6A:
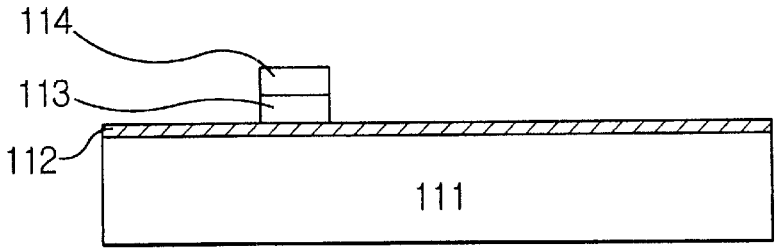
FIGS. 6A to 6H are views showing a process for manufacturing the fluid jetting apparatus according to the first preferred embodiment of the present invention.
Figure 6B:
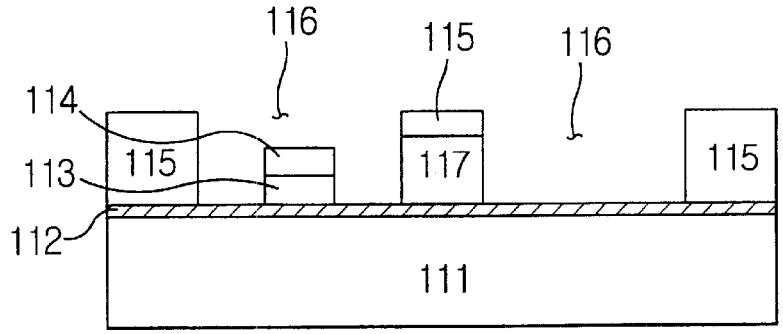

First, the heat driving part 110 is formed as follows. As shown in FIG. 6A, the exothermic body 113 and the electrode 114 are formed on the substrate 111 which has the insulated layer 112 formed thereon. As shown in FIG. 6B, after the working fluid barrier 115 is laminated on the exothermic body 113 and the electrode 114, the working fluid chamber 116 and the working fluid passage 117 are formed through an etching process. Here, either a dry etching or a wet etching may be employed.

Figure 6C:
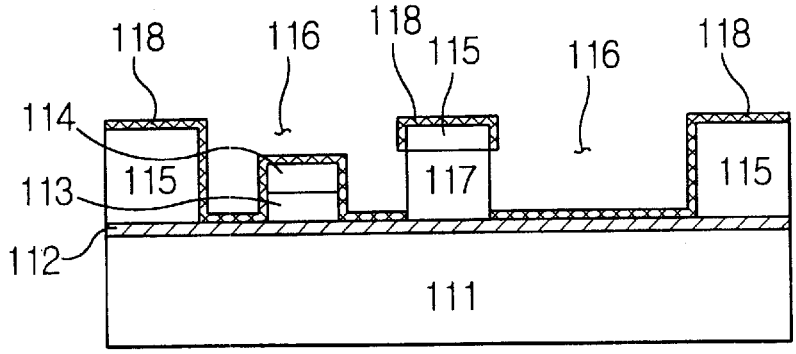
Figure 6D:
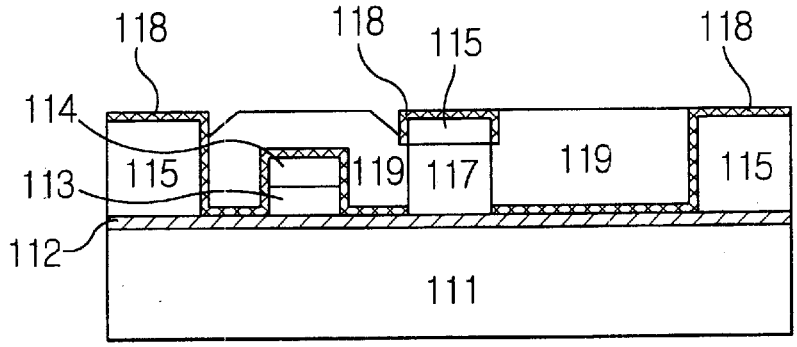

Next, as shown in FIG. 6C, the protective layer 118 is laminated to protect the heat driving part 110 including the working fluid barrier 115. Then, as shown in FIG. 6D, the sacrificial layer 119 is formed within the working fluid chamber 116, at the same height as the working fluid barrier 115. The sacrificial layer 119 is comprised of metal, or an organic compound, formed on the protective layer 118, and fills the interior of the working fluid chamber 116 so as to plane the upper side of the working chamber barrier 115. As the working fluid chamber 116 is not flat as can be seen from FIGS. 5, 6B, 6C and 6H, in which the exothermic element 113 and the electrode 114 protrude from the upper surface of the insulating layer 112 (FIGS. 5 and 6B through 6H), the sacrificial layer 119 filled in the working fluid chamber has angled edges. Later, the sacrificial layer 119 will be removed in the final step. The protective layer 118 is to prevent the other parts from being removed together with the sacrificial layer 119, when the sacrificial layer 119 is removed in the final step. It is preferable that the protective layer 118 is comprised of materials which have excellent properties of insulation and heat conductivity. The protective layer is laminated by a process of a "Diamond Like Coating." By using the "Diamond Like Coating," the protective layer 118 can provide such properties.

Figure 6E:
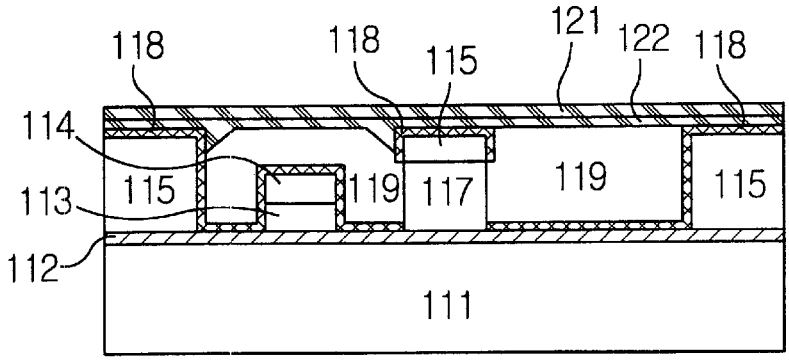

Next, as shown in FIG. 6E, when the sacrificial layer 119 fills the interior of the working fluid chamber 116, so that the upper side of the working fluid barrier 115 is essentially planed, the membrane 120 (formed of the polyimide coated layer 121 and the polyimide adhered layer 122) may be laminated thereon, directly. The membrane 120 is laminated through a spin coating and curing processes.

Figure 6F:
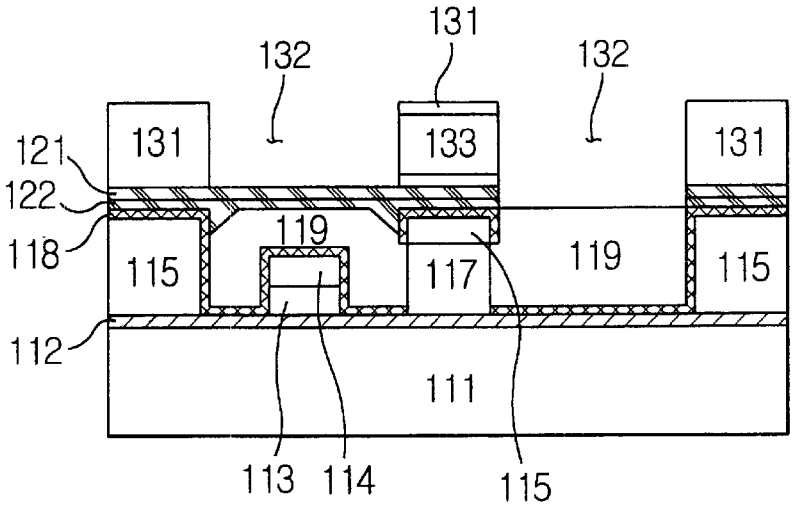

Then, as shown in FIG. 6F, the jetting fluid barrier 131 is laminated on the membrane 120. The jetting fluid chamber 132 and the jetting fluid passage 133 are formed in the jetting fluid barrier 131 through an etching process. Part of the membrane 120 above part the sacrificial 119 is also etched (see right side of FIG. 6F). The jetting fluid barrier 131 is laminated through the spin coating and curing processes. Alternatively, the jetting fluid barrier 131 may be laminated through a dry film lamination process, or a metal film lamination process which employs a sputtering process. The etching process may either be the dry etching or the wet etching.

Figure 6G:
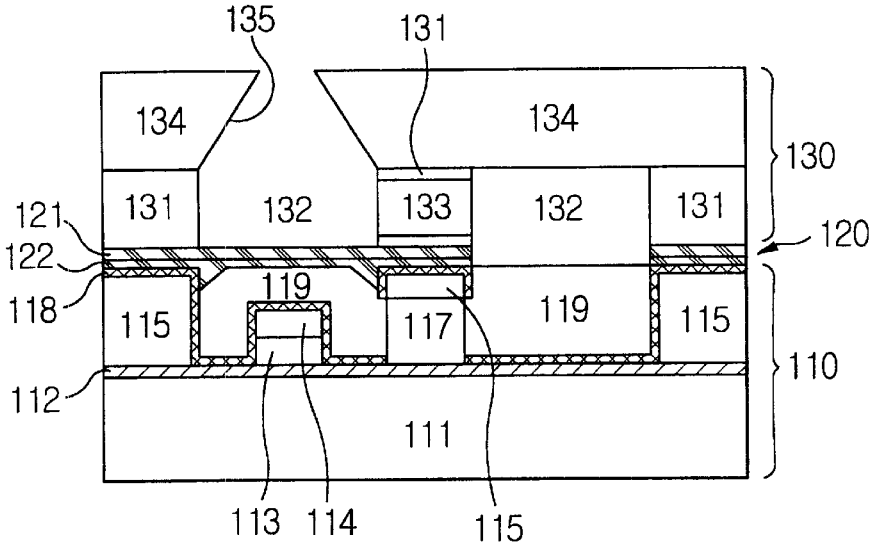

Then, as shown in FIG. 6G, the nozzle plate 134 is laminated on the jetting fluid barrier 131. Since the jetting fluid chamber 132 is formed in the jetting fluid barrier 131, the nozzle plate 134 is laminated through the dry film lamination process. Also, the nozzle 135 is formed in the nozzle plate 134 by etching, or a laser processing.

Figure 6H:
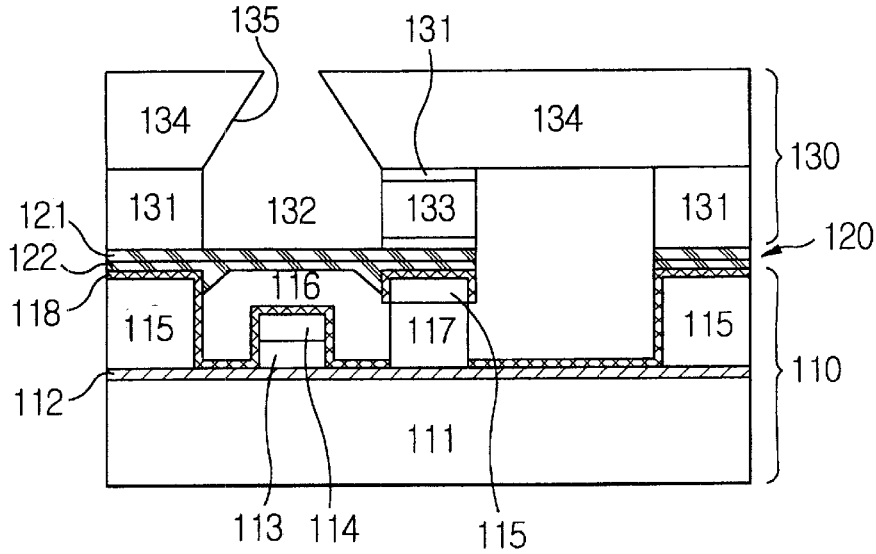

Finally, as shown in FIG. 6H, the sacrificial layer 119 is removed by a wet etching, and the fluid jetting apparatus is completed.

Figure 7:
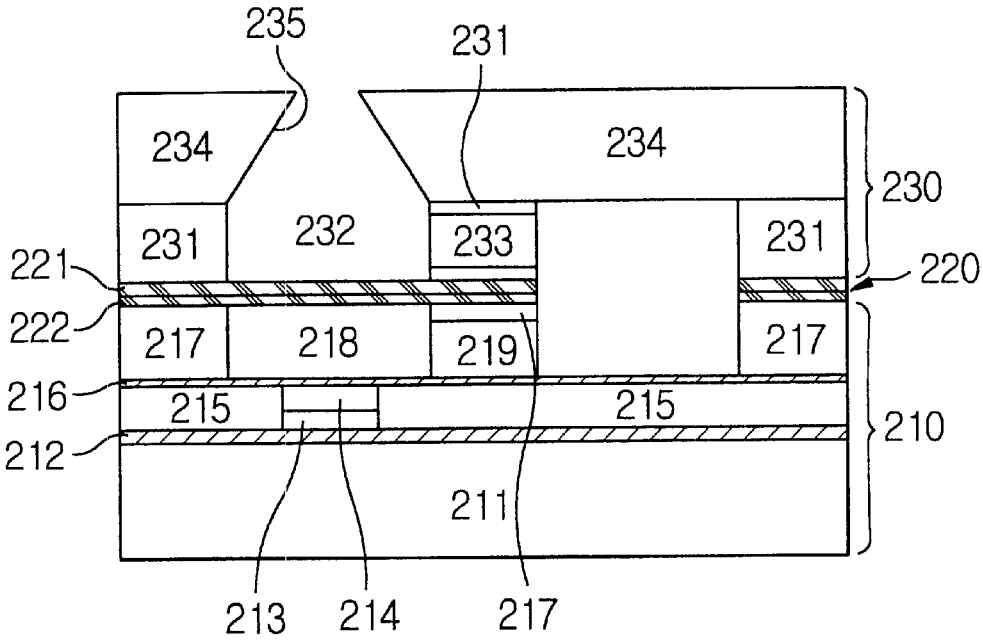
FIG. 7 is a vertical sectional view of the fluid jetting apparatus according to a second embodiment of the present invention.

Meanwhile, FIG. 7 is a vertical sectional view of a fluid jetting apparatus according to a second embodiment of the present invention, and FIGS. 8A to 8G are views showing a process for manufacturing the fluid jetting apparatus according to the second embodiment of the present invention.

The manufacturing process for the fluid jetting apparatus according to the second embodiment of the present invention includes: forming a heat driving part 210 inclusive of a sacrificial layer 219, forming a membrane 220 on the heat driving part 210, forming a nozzle part 230 on the membrane 220, and removing the sacrificial layer 219.

Here, the reference numeral 215 is a plane layer, 216 is a protective layer, and 219' is a sacrificial layer. Except for these, the like elements will be given the same reference numerals as the reference numerals, offset by 100, of the first embodiment throughout.

Figure 8A:
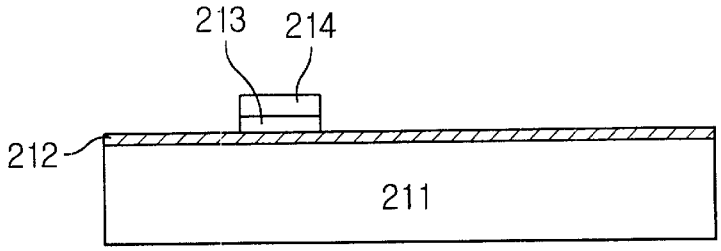
FIGS. 8A to 8G are views showing a process for manufacturing the fluid jetting apparatus according to the second embodiment of the present invention.
Figure 8B:
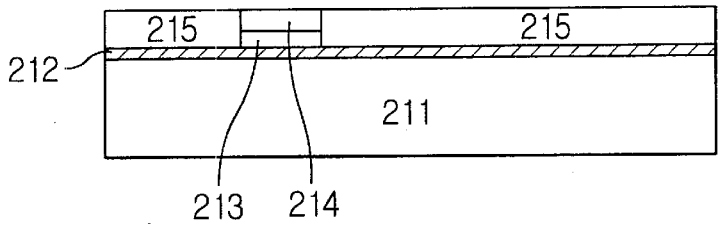
Figure 8C:
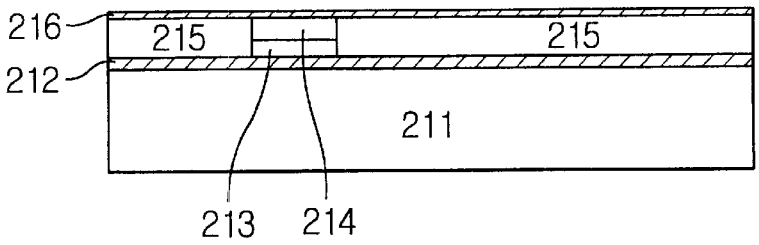

First, as shown in FIG. 8A, an exothermic body 213 and an electrode 214 are formed on a substrate 211 having the insulated layer 212. Next, as shown in FIG. 8B, the plane layer 215 is formed at the same height as the electrode 214 and the exothermic body 213. Then, as shown in FIG. 8C, the protective layer 216 is laminated. Since the electrode 214 and the exothermic body 213, formed on top of each other, and the plane layer 215 are formed at the same height, unlike the example described in the first embodiment, the protective layer 216 is laminated in a plane manner.

Figure 8D:
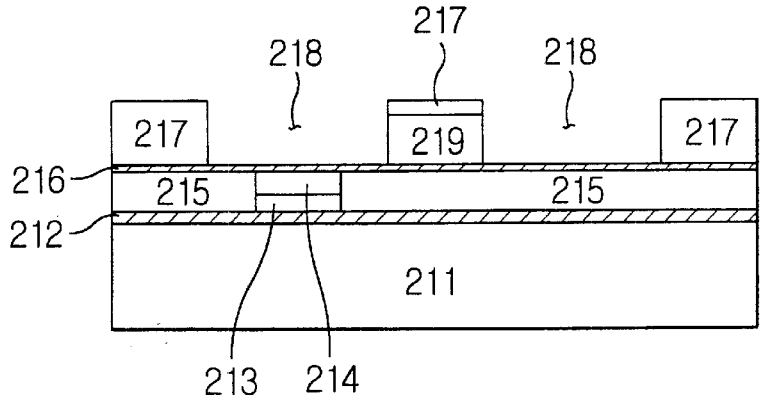
Figure 8E:
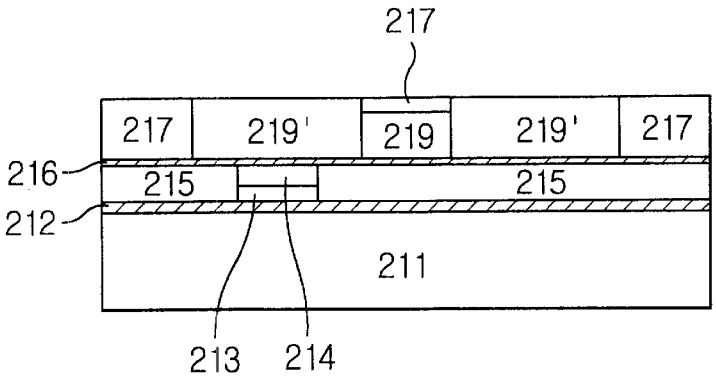

Then, as shown in FIG. 8D, after a working fluid barrier 217 is laminated on the protective layer 216, a working fluid chamber 218 and a working fluid passage 219 are formed by an etching process, such as dry etching or wet etching. Next, as shown in FIG. 8E, the sacrificial layer 219' is formed within the working fluid chamber 218 at the same height as the working fluid barrier 217. Here, the sacrificial layer 219' is comprised of metal, or an organic compound. The sacrificial layer 219' fills the interior of the working fluid chamber 218 so as to plane the upper side of the working fluid barrier 217.

Figure 8F:
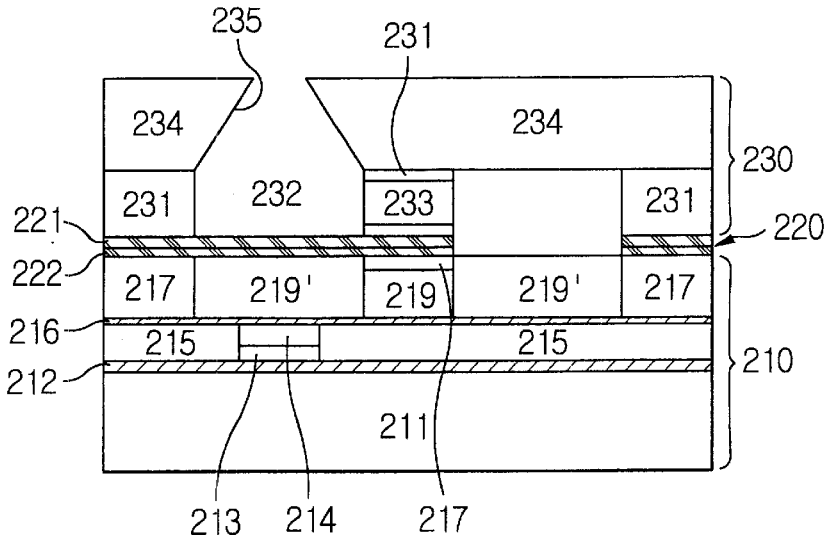
Figure 8G:
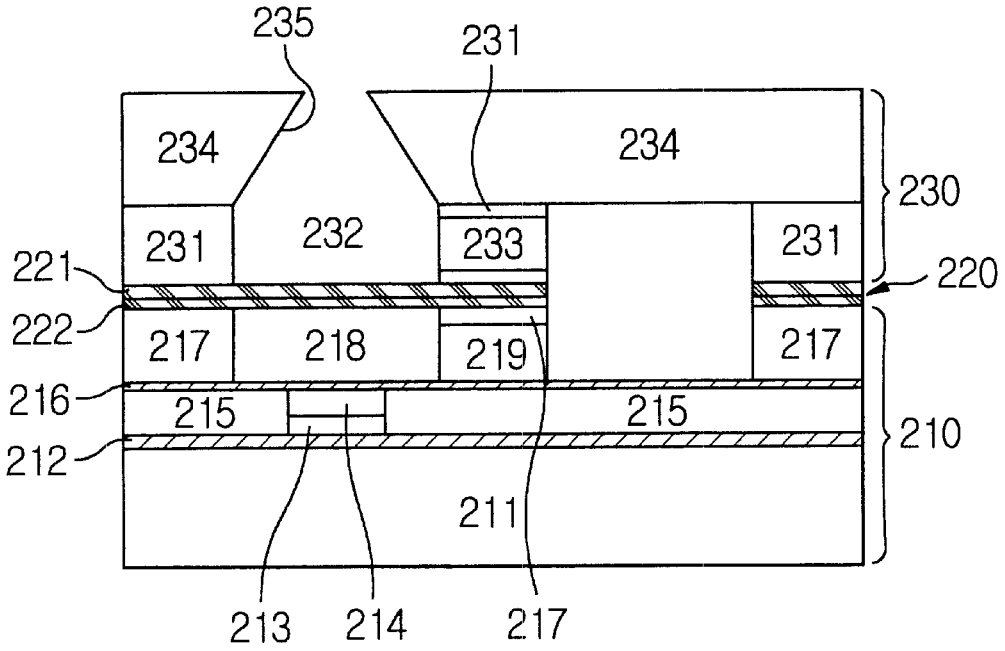

Then, as shown in FIG. 8F, the membrane 220 and the nozzle part 230 are formed on the working fluid barrier 217, sequentially. Since the membrane 220 (including the polyimide coated layer 221 and the polyimide adhered layer 222 and the nozzle part 230 (including the jetting fluid barrier 231, the jetting fluid chamber 232, the jetting fluid passage 233, the nozzle plate 234 and the nozzle 235) are formed by the same processes as described above with regard to the corresponding elements, offset by 100, in the first embodiment, a further description thereof will be omitted. Finally, as shown in FIG. 8G, by removing the sacrificial layer 219', preferably by a wet etching, the fluid jetting apparatus is completed to have the structure as shown in FIG. 7.

As described above, according to the present invention, since the heat driving part, the membrane, and the nozzle part are sequentially laminated to form the fluid jetting apparatus, the adhering process, which is required by the conventional manufacturing system, is no longer required. Accordingly, due to the very simplified manufacturing processes, the productivity, the reliability, and the quality of the fluid jetting apparatus is improved, and the percentage of defective parts is decreased.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A method of manufacturing a fluid jetting apparatus comprising:

forming an electrode and an exothermic body on a substrate;

laminating a plane layer on the substrate at a same height as the electrode and the exothermic body combined;

laminating a protective layer on the electrode and the plane layer;

laminating a working fluid barrier on the protective layer, and forming a working fluid chamber in the working fluid barrier;

forming a sacrificial layer on the protective layer and within an interior of the working fluid chamber at a same height as the working fluid barrier;

laminating a membrane on the working fluid barrier and the sacrificial layer formed to the same height as the working fluid barrier;

laminating a jetting fluid barrier on the membrane, and forming a jetting fluid chamber in the jetting fluid barrier;

laminating a nozzle plate on the jetting fluid barrier, and forming a nozzle in the nozzle plate; and removing the sacrificial layer.

2. A fluid jetting apparatus comprising:

a heat driving part which generates a driving force;

a nozzle part having a jetting fluid chamber interconnected to an exterior of the fluid jetting apparatus through a nozzle, the jetting fluid chamber to hold a jetting fluid; and a membrane which transmits the driving force generated from the heat driving part to the nozzle part to jet the jetting fluid through the nozzle;

wherein the heat driving part includes an electrode and an exothermic body formed on a substrate, a plane layer formed on the substrate at a same height as the electrode and the exothermic body combined, a protective layer laminated on the plane layer and the electrode, and a working fluid barrier laminated on the protective layer and formed with a working fluid chamber which holds a working fluid which generates the driving force by expanding in response to a heating of the exothermic body.

3. A fluid jetting apparatus, comprising:

a heat driving part which includes a substrate, a heating element including an electrode, formed on the substrate and to generate heat, a plane layer formed to a same height as the heating element on the substrate, to form a planar surface with the heating element, a protective layer formed on the planar surface, and a working fluid barrier have a working fluid chamber to store and heat working fluid;

a membrane formed on the working fluid barrier, to move in response to the heating of the working fluid; and a nozzle part formed on the membrane, and having a jetting fluid chamber storing jetting fluid, to emit the jetting fluid in response to the movement of the membrane.

4. A fluid jetting apparatus, comprising:

a heat driving part which includes a substrate, a heating element including an electrode, formed on the substrate and to generate heat, a plane layer formed to a same height as the heating element on the substrate, to form a planar surface with the heating element, and a working fluid barrier have a working fluid chamber to store and heat working fluid;

a membrane laminated on the working fluid barrier, to move in response to the heating of the working fluid; and a nozzle part laminated on the membrane, and having a jetting fluid chamber storing jetting fluid, to emit the jetting fluid in response to the movement of the membrane.

* * * * *